US006185970B1

(12) United States Patent
Latzel

(10) Patent No.: US 6,185,970 B1
(45) Date of Patent: Feb. 13, 2001

(54) METHOD OF AND SYSTEM FOR CONTROLLING A COOLING LINE OF A MILL TRAIN

(75) Inventor: Siegfried Latzel, Siegen (DE)

(73) Assignee: SMS Schloemann-Siemag AG, Düsseldorf (DE)

( * ) Notice: Under 35 U.S.C. 154(b), the term of this patent shall be extended for 0 days.

(21) Appl. No.: 09/431,458

(22) Filed: Nov. 1, 1999

(30) Foreign Application Priority Data

Oct. 31, 1998 (DE) ..... 198 50 253

(51) Int. Cl.[7] ..... B21B 27/06
(52) U.S. Cl. ..... 72/201; 72/200
(58) Field of Search ..... 72/201, 200, 202, 72/13.7, 13.2

(56) References Cited

U.S. PATENT DOCUMENTS 4,274,273 * 6/1981 Fapiano et al. ..... 72/201
4,569,023 * 2/1986 Wakamiya ..... 72/201
4,658,614 * 4/1987 Wakamiya ..... 72/201
4,785,646 * 11/1988 Uekaji et al. ..... 72/201

OTHER PUBLICATIONS

European Search Report Berlin, Feb. 9, 2000.
Excerpt from Iron and Steel Engineer Aug. 1989 "Model reference control of runout table cooling at LTV".

* cited by examiner

*Primary Examiner*—Rodney A. Butler
(74) *Attorney, Agent, or Firm*—Brown & Wood, LLP

(57) ABSTRACT

A method of controlling a cooling line of a mill train for rolling steel strips and sheets, with the method including calculating reference temperature conditions in the cooling line based on a preset reference temperature, calculating actual strip temperature conditions in the cooling line dependent on actual adjusted process parameters of the cooling line and specific process conditions of a strip, and controlling individually the process parameters of the cooling line by comparing the calculated actual temperature conditions with the reference temperature conditions; and a system for effecting the method.

10 Claims, 7 Drawing Sheets

$\hat{I}$
$I$
$d\alpha$
$I^*_{ref}$
$I_{ref}$
$\hat{V}$
$V$
$\hat{I}_{ref}$

METHOD OF AND SYSTEM FOR CONTROLLING A COOLING LINE OF A MILL TRAIN

BACKGROUND OF THE INVENTION

1. Field of the Invention

The present invention relates to a method of and a system for controlling a cooling line or installation and, in particular, a cooling line of a mill train for rolling steel sheets and strips.

2. Prescription of the Prior Art.

In addition to ever increasing requirements to the precision of geometrical measurements, to the quality of the surfaces, and to the mechanical properties of hot rolling strips, there exists simultaneously a desire to increase the flexibility of production plants for producing a multiplicity of different steels. Therefore, there exists a need in automatically operated cooling installations which would insure precise temperature conditions and different cooling strategies, i.e., different cooling processes and which, at the same time, are characterized by high flexibility and insure production of high quality steels. In order to meet these requirements, the process optimization and control methods, which are presently used for the automatization of cooling lines for laminar hot rolled strips, are based generally on mathematical process models.

The conventional methods are based on a classical concept of modeling of an entire system in a form of ideal strip points. The exchange of a strip point with the environment by heat conductance, convection, radiation energy is taken into account during modeling of a strip point.

In addition, inner energy is generated as a result of structural transformations. For modeling of strip points in the strip thickness direction, an equation for an unsteady one-dimensional heat conductance is solved by using the Fourier equation. As geometrical limits of the model, the location of the finishing train pyrometer, i.e., an entry location of an ideal imaginary strip point into the cooling line, and the location of the coiler pyrometer are used. Between these two locations, local adjusting points of the strip temperature are adjusted.

Two types of models are generally used: according to one type, the process model is incorporated into a control circuit, according to other type, the process model is separated from the control circuit. In the second step before the to-be-cooled strip enters the cooling line, the adjusting system of the cooling line is set up, with the feed forward and feed backward control during rolling serving for adjusting the remaining disturbance variables and a unprecise set-up.

In both cases, a separate strip section is divided into segments which are tracked during their passing through the cooling line. The obtained process and adjusting signals are associated with respective segments.

After a segment reaches a coiler pyrometer, in the first case, a reverse calculation of the segment is conducted with the aid of the process model. The difference between the measured and calculated coiler temperature is adapted and is taken into consideration for a following adjustment of the adjusting system in accordance with actual process conditions (temperature of the finishing train, strip speed, etc. . . . ). These calculation sequence is repeated cyclically during the rolling process.

The model adaptation serves for increasing the predicted precision of the cooling model. The results of the calculation of a model are constantly compared with actual, measured results of cooling, and error minimizing its conducted.

A serious drawback of this classical concept consists in that because of a need to integrate the strip segments, a large number of data need be produced and processed. In addition, the adjusting system of the cooling installation or line, e.g., the local distribution of the cooling water and the number of actuated cooling apparatuses, cannot be controlled with a sufficient speed and a sufficient flexibility. There exists a danger of undercooling or overcooling of the strip section when the strip speed abruptly changes.

Accordingly, an object of the present invention is to provide a method of and a system for controlling a cooling line, in particular, a cooling line for a milling train which would insure rapid and automatic control process, with reducing expenditures associated with collection and processing of data.

SUMMARY OF THE INVENTION

This and other objects of the present invention, which will become apparent hereinafter, are achieved by providing a method of controlling a cooling line which includes calculating reference temperature conditions in the cooling line based on a preset reference temperature, calculating actual strip temperature conditions in the cooling line dependent on actual adjusted process parameters of the cooling line and specific process conditions of a strip, and controlling individually the process parameters of the cooling line by comparing the calculated actual temperature conditions with the reference temperature conditions; and by providing a system including means for calculating reference temperature conditions in the cooling line based on a present reference temperature, means for calculating actual strip temperature conditions in the cooling line dependent on actual adjusted process parameters or the cooling line and specific process conditions of a strip, and means for controlling individual the process parameters of the cooling line by comparing the calculated actual temperature conditions with the reference temperature conditions.

The inventive process is based on considering the entire system of the cooling line not as a sum of separate strip points or segments, but rather as a temperature curve of the strip over the length of the cooling line. According to the inventive method, the influence of the cooling action on the drop of the temperature curve is continuously calculated or monitored with an aid of a mathematical process model, the temperature curve is compared with a reference temperature curve, and deviations along the cooling line length are individually compensated.

The model, on which calculation is based, is continuously adapted. The separate steps of the controlling process a cyclically calculated. The controlling process includes the following step:

Calculating actual temperature profile of a strip or sheet along the cooling line dependent on actual process parameters and specific process conditions of the strip or sheet.

Preferably, the adaptation of the model, on which calculation of the actual strip conditions is based, is effected, based on the actually measured temperature values (Tmeas.), by changing the model parameters with an object to minimize the error of the model.

The controlling process further includes the steps of calculating in advance a reference temperature profile based on a error-minimized model taking into consideration a preset reference temperature T ref; and individually controlling process parameters along the cooling line by comparing the calculated actual temperature profile with the reference temperature profile.

The calculation of the strip temperature condition is effected taking into the account real conditions. On the basis of a preferably error-minimized model, reference temperature conditions are calculated.

The model, on which the inventive method is based, eliminates the division of a strip in separate segment, as it was required by a classical model. Thereby, the amount of data and the expenditures, which are associated with the collection and processing of data, are substantially reduced. Further, the inventive method substantially reduces the adjusting time by reducing the time associated with strip transportation.

The process parameters of the cooling line are actual characteristics of the cooling line which include the number of actuated separate cooling apparatuses, the amount and the velocity of the cooling water, and the cooling water temperature. The adjustment of these control elements of the cooling line is effected individually and in accordance with the reference temperature conditions, and these control elements provide for increased speed and flexibility of adjusting of separate control elements.

Under specific process conditions, the properties of the to-be-cooled strip are understood. These conditions includes strip speed, strip thickness, finishing train temperature, and characteristics of the strip material.

The actual temperature value or the reference temperature, preferably, are the actual and reference temperatures of the to-be-cooled strip before the entrance in the coiler or at the exit of the cooling line. The inventive control process permits to establish a coiler temperature with small temperature tolerances and to compensate the difference is speed and in the temperature at the end of the rolling process to a most possible extent.

Preferably, the cooling line includes a plurality of cooling apparatuses. In a preferred embodiment of the present invention, the control elements of the cooling apparatuses are controlled independently of each other for separately controlling the upper and bottom strip surfaces.

Advantageously, the setup calculation of the expected strip temperature condition is effected dependent on specific process conditions of to-be-cooled strips before their entrance into the cooling line or installation. This setup calculation is effected before the actual control process is conducted. This preliminary setup calculation of the strip temperature conditions permits to more quickly provide an operational point for the subsequent control process.

The inclusion in the process of thermophysical and fluidodynamic relationships permitted to obtain a precise process picture during a control cycle.

The novel features of the present invention, which are considered as characteristic for the invention, are set forth in particular in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
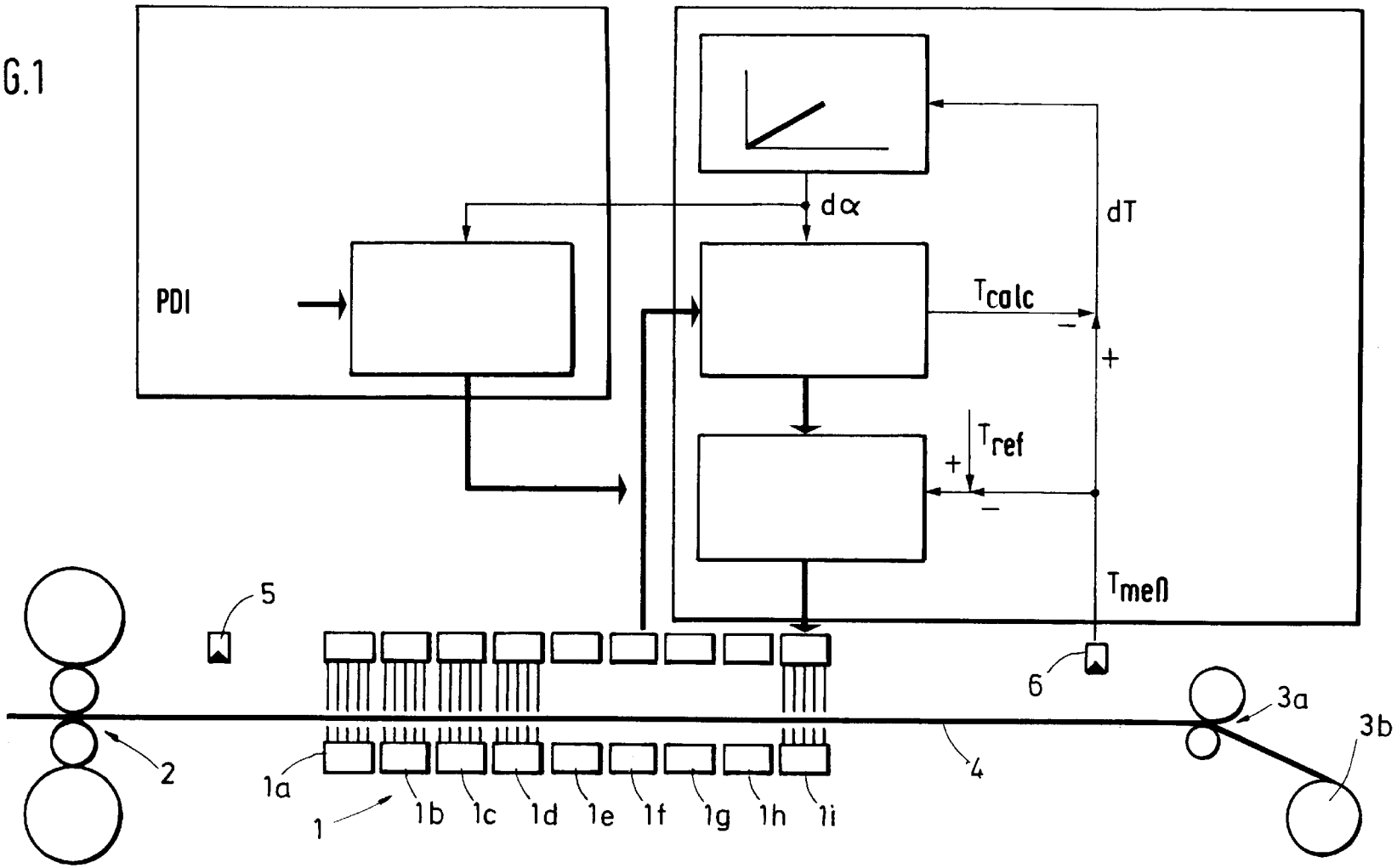
FIG. 1 a schematic function diagram of a control process according to the present invention.

FIG. 1 shows a schematic view of a cooling installation 1 for a laminar strip which is provided on a roll-out table of a wide strip hot rolling train between a last stand 2 of the finishing train and driving rolls 3*a* or a coiler 3*b*. The strip cooling installation 1 is formed of a plurality of cooling apparatuses 1*a*, 1*b*, 1*c*, 1*d*, 1*e*, 1*f*, 1*g*, 1*h*, and 1*a* functioning independently from each other, and control elements of which a separately controlled in accordance with the temperatures of the strip top and bottom surfaces. A first pyrometer 5 is provided between the last rolling stand 2 of the finishing train and the first cooling apparatus 1*a* of the cooling installation 1*f* or measuring the temperature of the movable strip. A second pyrometer for measuring the strip temperature is provided at a small distance from the pinch rolls 3*a* or the coiler 3*b* in front of the driving rolls 3*a* or the coiler 3*b*.

FIG. 1 also shows separate steps of the control cycle according to the present invention.

During the rolling step, with the aid of a cooling model, a strip temperature curve is calculated (observed), and the measured coiler temperature Tmeas, is compared with the corresponding calculated temperature Tcalc. The measured coiler temperature is the temperature, which is measured by the pyrometer 6. Tcalc. represents a corresponding discrete temperature value on the monitored temperature curve.

In addition, an adaptation of the model and communication of the calculated temperature curve to the temperature controller takes place.

In order to increase the fastness of the control process at the head of the strip, a setup calculation consists in a set-up calculation of the strip temperature curve dependent on specific process conditions of to-be-cooled strip before it enters the cooling installation. This preliminary calculated strip temperature curve serves during the rolling process as an operating point for the temperature control.

Figure 2:
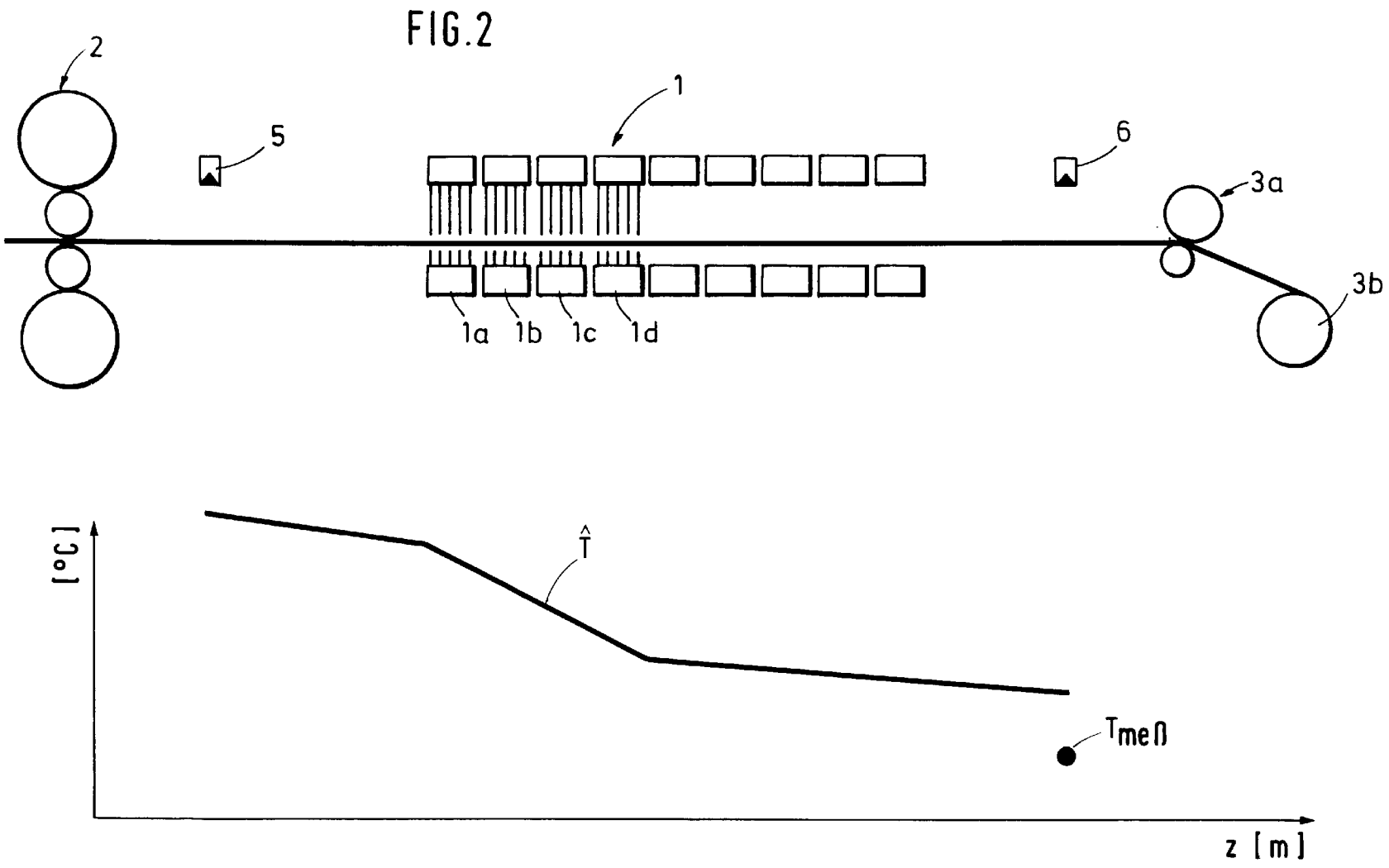
FIG. 2 a schematic diagram showing a first step of the control process according to the present invention.

FIG. 2 shows a strip temperature curve [in ° C.] over a strip length [m] calculated with an aid of a model, i.e., observed. This first step of the regulating or control circuit relates to the calculation of the strip temperature curve or the temperature conditions in the cooling line between the pyrometers 5 and 6 dependent from actual adjusted process parameters with the aid of a model, i.e., the first step represents the so-called observation. The cooling curve has, in the shown example, a relatively sharp drop in the region of the first four active cooling apparatuses 1*a*, 1*b*, 1*c*, 1*d*. Then, the cooling curve drops smoothly.

During the control cycle, in a second step, an end temperature value Tmeas. is measured at a predetermined point of the strip after it passed the cooling line. The end temperature value represents, preferably, the temperature of the strip shortly before it enters the coiler 3*b*. This temperature is measured with the pyrometer 6.

Figure 3:
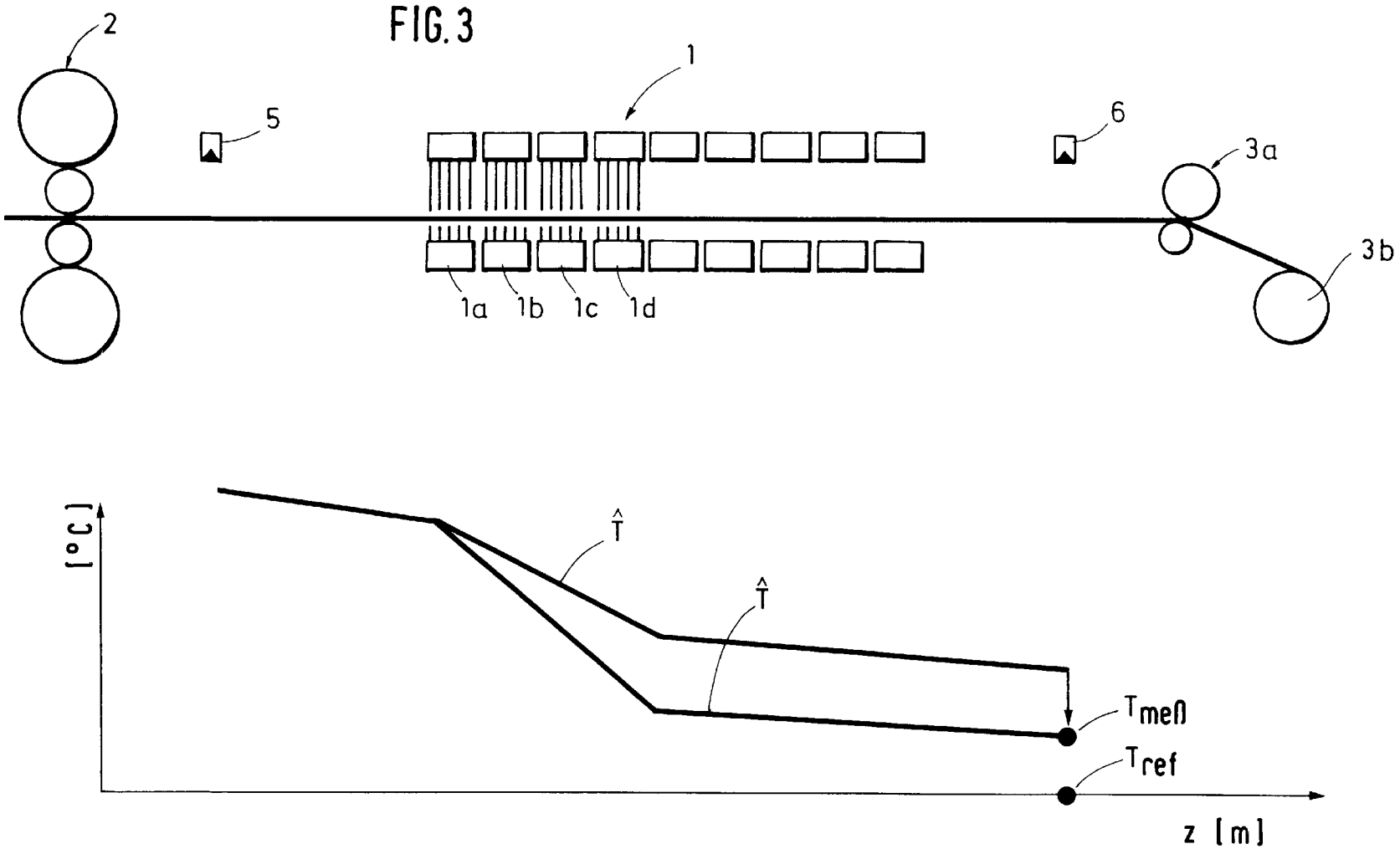
FIG. 3 a schematic diagram showing a second step of the control process according to the present invention.

The strip temperature at the coiler depends primarily from the obtained quality of the strip material and is usually varies within a range from 250 to 750° C. In case the actual end temperature Tmeas., i.e., the coiler temperature deviates from a corresponding value of the calculated curve, as shown in FIG. 2, an adaptation for minimizing the error of the model takes place (see FIG. 3). The adaptation is effected by a suitable change of the model parameter in order to obtain an adapted curve on which the measured coiler temperature lies.

Figure 4:
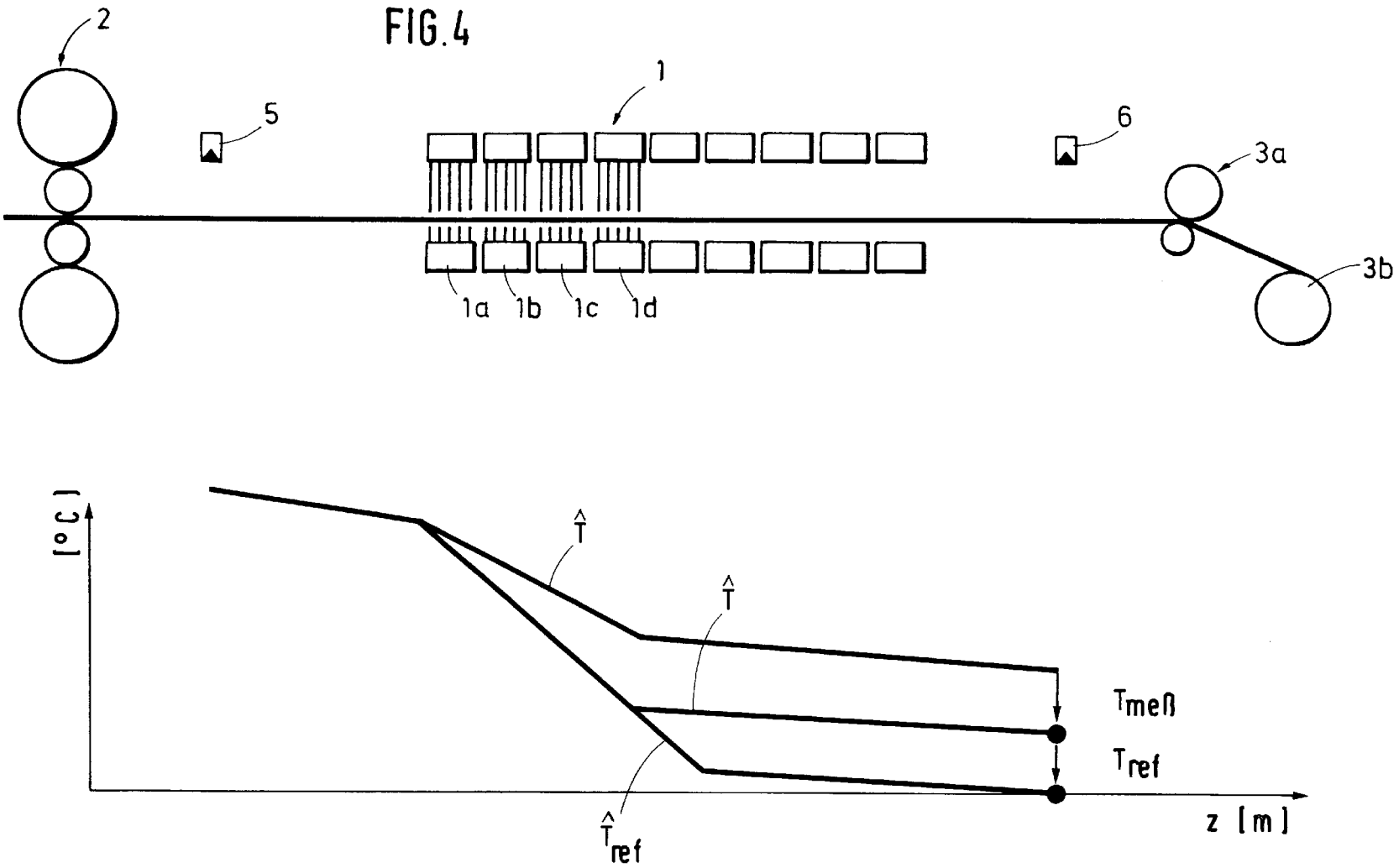
FIG. 4 a schematic diagram showing a third step of the control process according tot he present invention.

On the basis of this error-minimized model, a reference temperature curve is calculated based on a reference temperature Tref. which usually is a desired coiler temperature. This step is shown in FIG. 4.

This curve is based on the same initial value as the first calculated temperature curve, but on a different end value, i.e., on the reference value Tref.

An individual control of each cooling zone is effected based on comparison of the calculated temperature curve with the reference temperature curve separately for the strip upper surface and the strip bottom surface. The control is effected by the control elements of the cooling apparatuses of the cooling installation.

Figure 5:
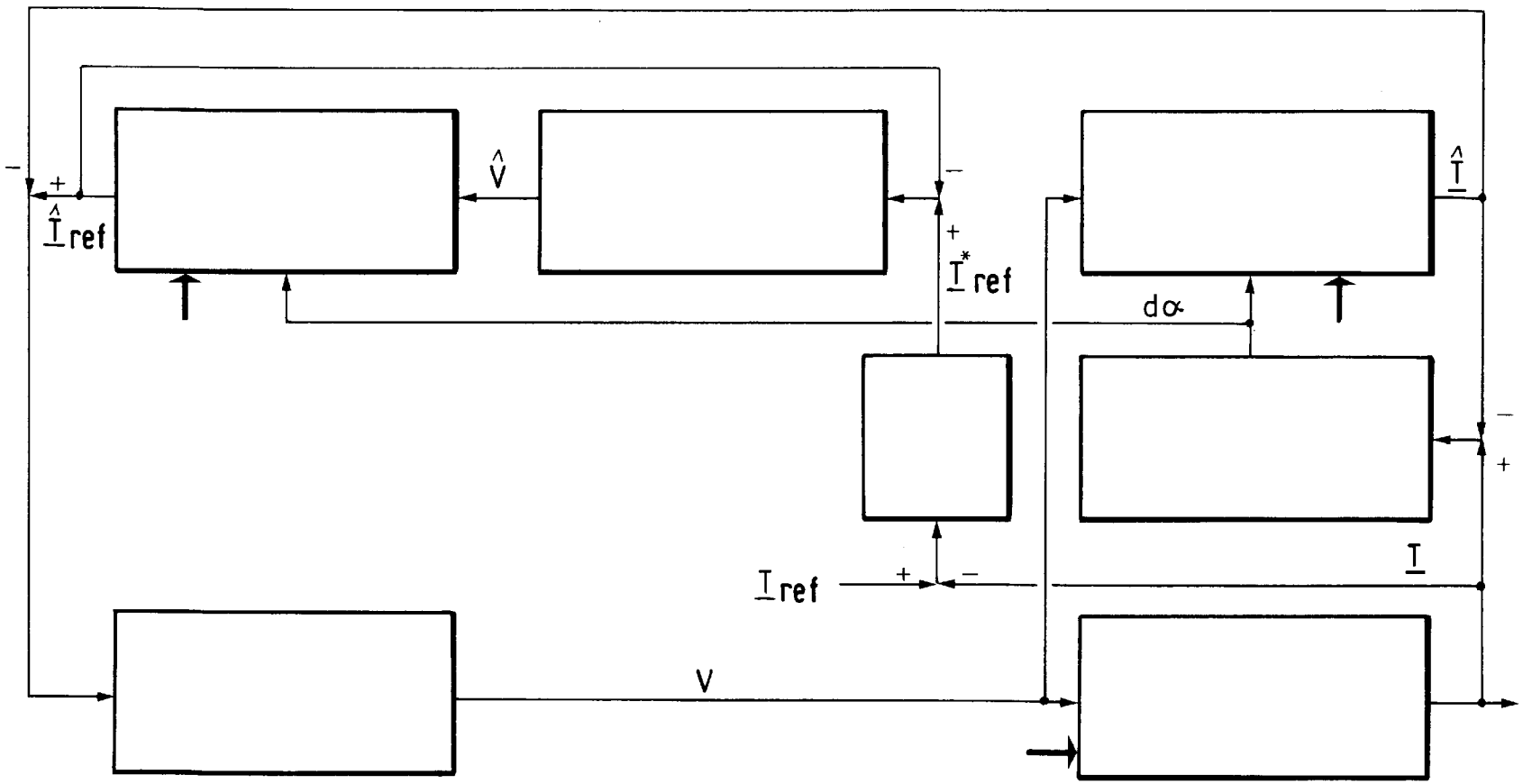
FIG. 5 a schematic view showing system elements of a temperature controller.

FIG. 5 shows schematically separate units for effecting the inventive process. With the aid of process monitors or a model, the temperature condition of the strip in the cooling installation is continuously observed or calculated. Upon an occurrence of a deviation between calculated and measured coiler temperatures, the model adaptation takes place, i.e., the calculated coiler temperature is a adjusted based on the actual measurement temperature value Tmeas.

The temperature controller includes a unit for calculating the reference temperature curve, a so-called predictor. This calculation is effected cyclically in order to insure a correct process cycle within the cooling installation to achieve a predetermined coiler temperature dependent from time-dependant process disturbances such as variation of the strip speed, strip thickness, change in the finishing train temperature, etc. . . . .

In addition, there is provided a process monitor-controller, which adjusts the entire system based on conventional control methods, e.g., an integral action controller. The process monitor controller is actuated in case a deviation of the actual coiler temperature from a predetermined coiler temperature is observed despite the adaptation of the model. The process monitor-controller compensates metrological non-comprehensible disturbances and functioning errors of the system and insures a perfect product quality by adjusting the reference and actual coiler temperature.

Figure 6:
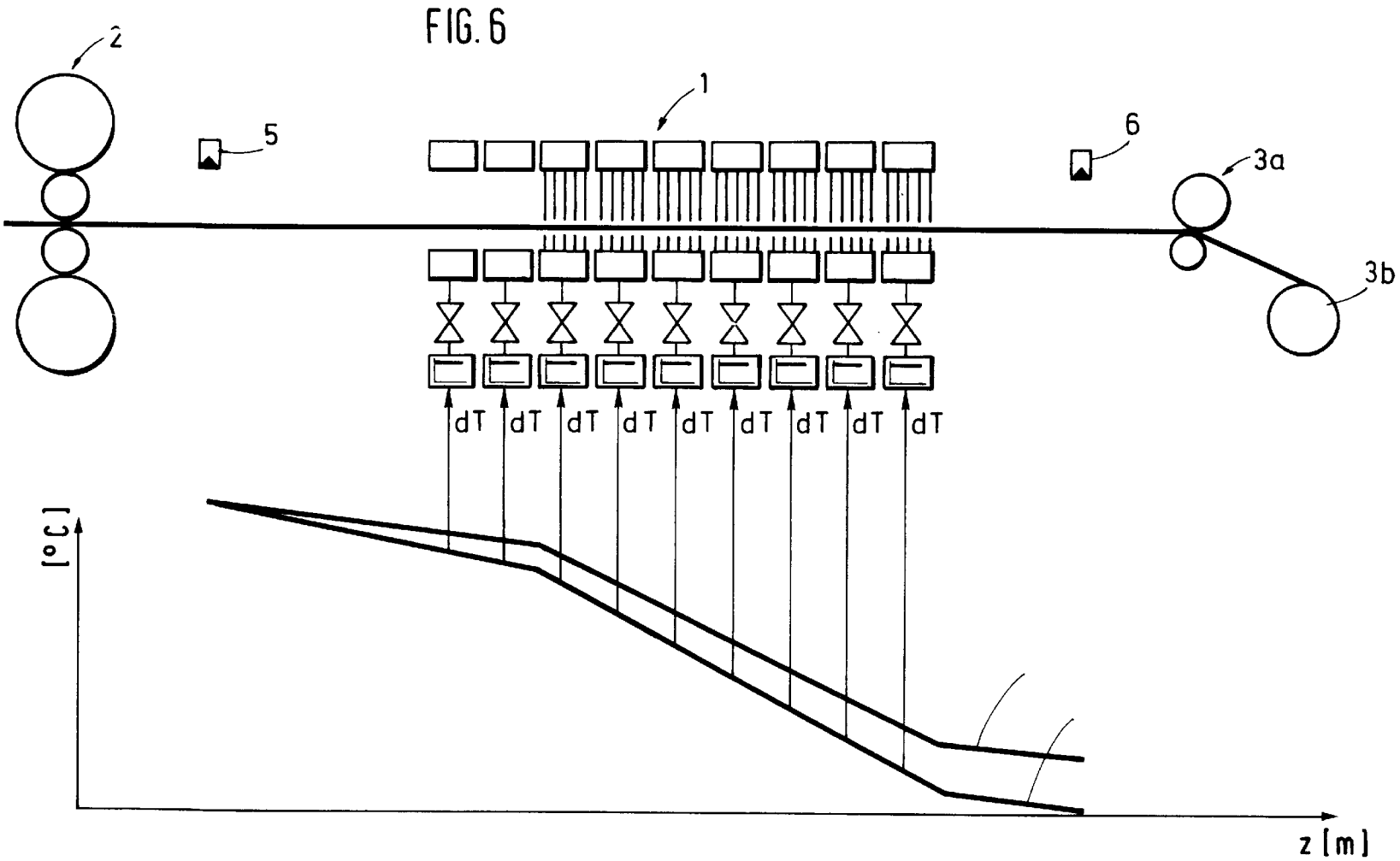
FIG. 6 a schematic diagram of a thermodynamic model for effecting the temperature control, and FIG. 7 a schematic diagram of another thermodynamic model.

As shown in FIG. 6, each cooling zone is individually adjusted, upon a comparison with an associated reference temperature, when an actual strip temperature curve over the strip length within the cooling installation is known. This means that for arbitrary discrete local coordinates within the cooling installation, the temperature condition of the strip at each time point should be known. The strip temperature curve within the cooling installation cannot be measured but can be calculated or observed based on a model.

A mathematical model for calculating the strip temperature condition in the cooling installation, on which the inventive method is based, is built based on the following thermodynamic and fluidic principles.

The rolling process is assumed to be thermodynamically an unsteady flow process in an open system. If the finishing train pyrometer, the coiler pyrometer, the strip upper and bottom surfaces are considered as thermodynamic system limits of the cooling installation, then mass and energy in form of an enthalpy at the finishing train pyrometer flows into the system mass and the energy in form of enthalpy at the coiler pyrometer flows out of the system, and the energy at the upper and bottom strip surfaces flows out of the system in form of heat. The control process is further based on a possibility to divide the cooling process in an arbitrary number of partial processes, with the thermodynamic system being formed of a chain of partial processes. For each partial process, the energy and mass balance must be preserved.

Generally, for balancing of an extensive parameter, e.g., energy, mass, pulse, etcs. . . . , in an arbitrary but space-bound system, a general balance equation is used.

$$\frac{\partial e_v}{\partial t} = -div\, i_S + \Gamma_V \tag{1.1}$$

wherein

| | | |
|---|---|---|
| ev | is | density of the extensive parameter, |
| is | is | flow of the extensive parameter through the surface in a unit of time and in unit of surface section, and |
| Γv | is | produced or consumed amount of the extensive parameter in units of volume and in unit of time. |

The mass balance for a partial process can be described as follows. The system mass consists of masses of structural components pι (with Σ pι=1) together with density ρ and volume V $$m=\Sigma V_i\rho_i(T)p_i(T) \tag{1.2}$$

with other components being disregarded, for a mixture consisting of austenite (γ) and ferrite (α)

$$m=V\cdot\rho(T)=V\cdot[(1-p(T))\cdot\rho_\alpha+p(T)\cdot\rho_\gamma] \tag{1.3}$$

For a specific mass, i.e., the density $$e_v = \rho(T) = \lim_{V\to 0}\frac{m}{V} = (1-p(T))\cdot\rho_\alpha + p(T)\cdot\rho_\gamma \tag{1.4}$$

Based on the transfer process, the mass flows over the system limits $$i=\dot{m}=\rho(T)\cdot\dot{V}=\rho(T)\cdot s\cdot\dot{z} \tag{1.5}$$

$$i_v = \lim_{s\to 0}\frac{\dot{m}}{s} = \rho(T)\cdot\dot{z} = [(1-p(T))\cdot\rho_\alpha + p(T)\cdot\rho_\gamma]\cdot\dot{z} \tag{1.6}$$

wherein s is an upper surface vector and $\dot{z}$ is a velocity vector.

A mass of a space-bound system, which is produced in a unit of time, can be represented by a time-changeable density. From (1.3), it follows $$\Gamma_v = \lim_{V\to 0}\frac{\dot{m}}{V} = \dot{\rho}(T) = (\rho_\gamma - \rho_\alpha)\cdot\frac{d\,p(T)}{d\,t} \tag{1.7}$$

Considering that the mass stream flows only in the coordinate direction $z_1$ (longitudinal direction), the mass balance in Cartesian coordinate is $$\dot{p}(T) = -\dot{z}_1 \cdot \frac{dp(T)}{dz_1} + \dot{T} \cdot \frac{dp(T)}{dT} \tag{1.8}$$

The energy balance for a partial process would be as follows. According to the first law of thermodynamics, the energy of a system consists of the enthalpy and potential and kinetic energy. For a stationary system, no changes of the potential and kinetic energy occur, therefore, the energy E consists only of the enthalpy H with U=inner energy $$E=H(T)=U(T)+m\cdot p\cdot V \tag{1.9}$$

From this equation, disregarding the volume change p.V $$e_V = \lim_{V\to 0} \frac{U(T)}{V} = \rho(T)\cdot u(T) \tag{1.10}$$

Over the space-bound system limits, the energy flows in form of heat Q, substituting the enthalpy H· by h-specific enthalpy, the following equation is obtained $$i=\dot{H}(T)+\dot{Q}(T)=\dot{m}\cdot h(T)+s\cdot\dot{q}(T) \tag{1.11}$$

$$i_S = \lim_{S\to 0} \frac{I}{s} = \rho(T)\cdot\dot{z}\cdot h(T) + \dot{q} \tag{1.12}$$

With regard to the cooling rate and the reference coiling-temperature, the free emerging energy during the structural transformation (γ→α—transformation) should be taken in consideration.

Therefrom the enthalpy of the strip will be $$H(T)=\Sigma p_i(T)H_i(T) \tag{1.13}$$

For a mixture consisting of austenite and ferrite, disregarding the remaining components, the following equation is obtained $$H(T)=p_\alpha(T)\cdot H_\alpha(T)+p_\gamma(T)\cdot H_\gamma(T) \tag{1.14}$$

The consumed or produced, per unit of time, units of volume of energy are calculated from $$\Gamma=\dot{H}(T)=\dot{m}(T)\cdot h(T)+m(T)\cdot\dot{h}(T) \tag{1.15}$$

$$\Gamma_V = \lim_{V\to 0} V = \dot{p}(T)\cdot[(p_\gamma(T)-\rho_\alpha(T))\cdot h(T)+\rho(T)\cdot[h_\gamma(T)-h_\alpha(T)] \tag{1.16}$$

The equations are obtained, taking into consideration $$cp(T) = \frac{dh(T)}{dT} = \frac{du(T)}{dT} \tag{1.17}$$

wherein cp=caloric content $$\dot{q} = -grad\left(\lambda(T)\frac{\partial T}{\partial z}\right) \tag{1.18}$$

wherein λ=thermal conductivity for Cartesian coordinates, the sought energy balance would be $$\rho(T)\cdot cp(T)\cdot\dot{T} = +\lambda(T)\cdot\left[\frac{\partial^2 T}{\partial z_1^2}+\frac{\partial^2 T}{\partial z_2^2}\right]-\rho(T)\cdot cp(T)\cdot\dot{z}_1\cdot\frac{\partial T}{\partial z_1}+\dot{p}(T)\cdot[(p_\gamma-\rho_\alpha)\cdot h(T)+\rho(T)\cdot(h_\gamma(T)-h_\alpha(T))] \tag{1.19}$$

In (1.19), it is assumed, that the thermal conductivity (T) is not based on direction. The thermal conductivity in the width direction is disregarded, and the enthalpy stream flows only in the longitudinal direction of the cooling line.

Figure 7:
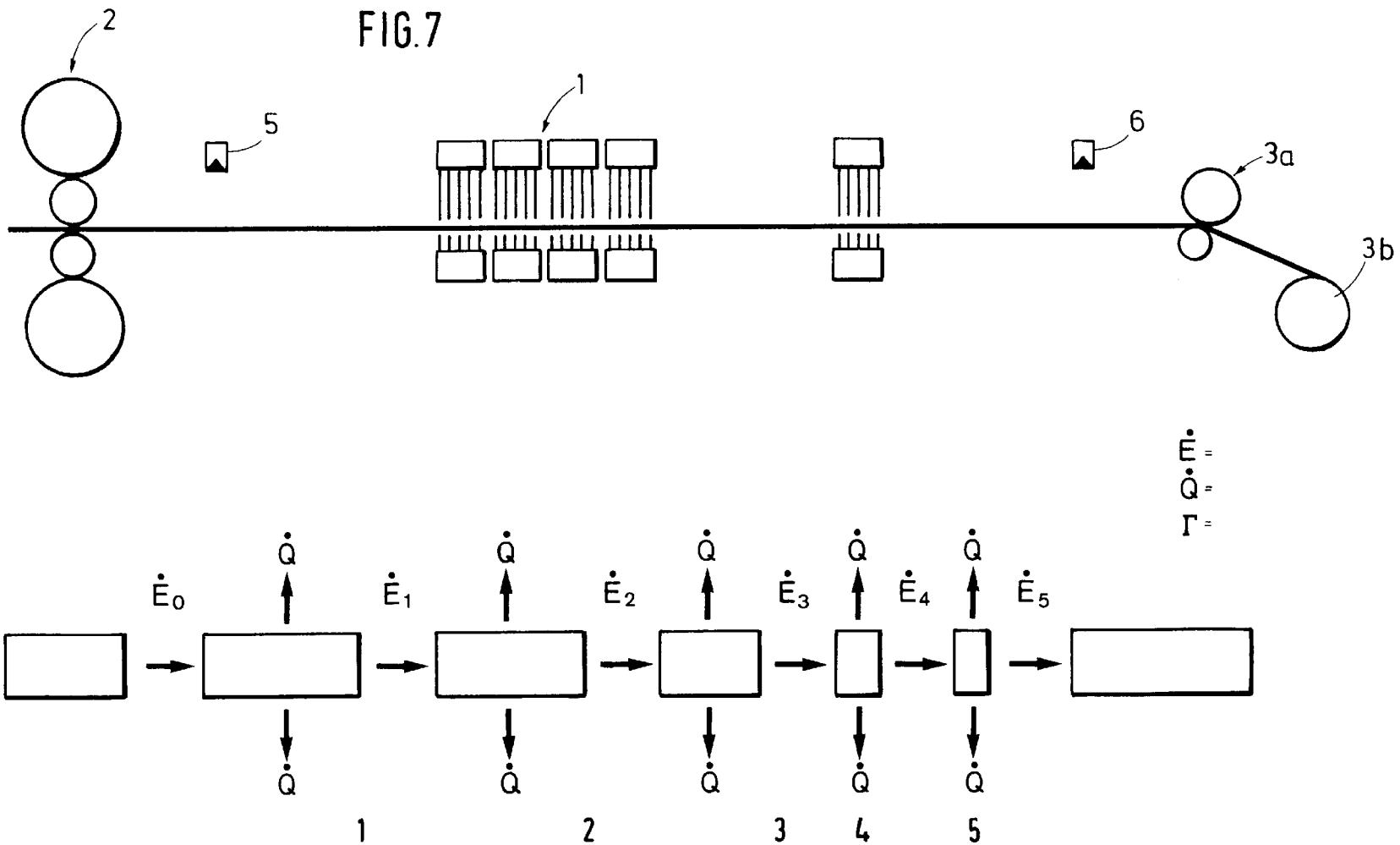

When the entire system is divided in subsystems, from the equation (1.8) and (1.9), a system of linked differential equation is obtained. A system for calculating temperature condition along the longitudinal coordinate $Z_1$, and the strip thickness coordinate $Z_2$ is obtained, e.g., from the differential equations. The truncation of the temperature network takes place in the longitudinal and thickness directions with non-equidistant spacing between nodes (please see FIG. 7).

In addition to the thermomechanical consideration, fluidic consideration are taken into account in modeling. With this model, the flow rate of the cooling water at the exit of the cooling apparatus can be calculated. The flow velocity significantly influences the calculation of the heat transmission coefficient for the strip upper and bottom surfaces. It is obtained based on the hydrodynamic relationships between the reservoir and the conduits connecting the cooling apparatus with the reservoir and, thereby, on the entire withdrawal of the cooling water from the reservoir. In particular, turning the cooling apparatus on and off significantly influences the calculation of the actual heat transmission coefficient until a stationary flow condition is established. Assuring that the cooling water is friction-free and incompressible, for the dynamic calculation of two points of the same flow thread, the instantaneous equation for an incompressible fluid according to Bernoulli will be $$\int_{(1)}^{(v)} \frac{\partial c}{\partial t} ds + \frac{c_v^2 - c_1^2}{2} + g\cdot(z_v - z_1) + \frac{p_v - p_1}{\rho} + \frac{\Delta p}{\rho} = 0 \tag{1.20}$$

wherein $c_i$ is flow velocity in the point i, s is a coordinate of the of the flow thread, z is a height coordinate of the point i $p_i$ is the pressure in point i Δp is the pressure loss as a result of friction and structural obstacles, ν is an exit location of the cooling water for the conduit system, ρ is the fluid density, and g is a constant.

In a mechanical installation, the vessels have simple geometrical forms, and the conduit section have different diameters. For discrete conduit transition, in compliance with the continuity equation:

$$c_{v+1} = \frac{A_v}{A_{v+1}} c_v \tag{2.21}$$

wherein n=ν−1—section of a flow thread, and A=cross-sectional surface.

From (2,20), the sought differential equation for the description of an unsteady flow condition between the water level in a high-level reservoir and an arbitrary point v in the conduit system would be $$\ddot{v}_v \cdot [a(z) + b_1] + b_2 \cdot \dot{v}_v^2 + b_3 \cdot g \cdot (z_v - z_P) + b_3 \cdot \frac{\Delta p}{\rho} = 0 \quad (2.22)$$

wherein

| | | |
|---|---|---|
| $a(z) = A_v^2 \cdot \int_{(12)}^{(v)} \frac{A_v}{A_{12}(z)} dz$ | High-level reservoir | (2.23) |
| $b_1 = A_v^2 \cdot \sum_{1=2}^{v-1} \frac{A_{i+1}}{A_i} \cdot L_{Ri}$ | Conduit system constant | (2.24) |
| $b_2 = \frac{1}{2} \cdot (A_v^2 - A_1^2)$ | Cross-sectional constant | (2.25) |
| $b_3 = A_v^2$ | Outflow constant | (2.26) |
| $\Delta\rho/\rho$ | Pressure loss due to obstacles and conduit lengths | (2.27) |

The equation (2.22) describes an unsteady flow condition of a separate apparatus. For the modeling of the entire system, this non-linear differential equation of the second order for each apparatus should be obtained. The linkage of $n_K$ differential equations is effected with a continuity equation, because for a water level of a high-level reservoir the following equation need be fulfilled $$A_1(z) \cdot \dot{z}_1 = \dot{v}_p \cdot A_p + \sum_{i=1}^{a_K} A_{2i} \cdot \dot{v}_{2i} \quad (2.28)$$

wherein

Ap is tubular cross-section of a pump, and

Vp is a volume flow delivered by the pump.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A method of controlling a cooling line of a mill train for rolling steel sheets and strips, the method comprising the cyclically conducted steps of:

calculating in advance a reference temperature profile between a site of finishing train pyrometer and a site of a coiler pyrometer based on a setup reference temperature;

calculating actual temperature profile of one of a sheet and a strip between the site of the finishing train pyrometer and the site of the coiler pyrometer based on actual adjusted process parameters of the cooling line and specific process conditions of the one of a sheet and a strip; and controlling individually the process parameters along the cooling line at particular locations of the cooling line where the actual temperature of the one of a sheet and strip deviates from the set temperature by comparing the calculated actual temperature profile with the reference temperature profile at the particular locations of the cooling line.

2. A method as set forth in claim 1, wherein the step of calculating the actual temperature profile includes a step of adapting a model on which calculation of the actual temperature profile is based by using an actual temperature value of the one of a to-be cooled strip and sheet.

3. A method as set forth in claim 1, wherein the step of calculating the actual temperature profile includes setup calculation of an expected temperature profile dependent on specific process conditions of the one of a to-be-cooled strip and sheet before the one of the strip and sheet enters the cooling line before actually conducting the control process, and adjusting corresponding process parameters of the cooling line in accordance with the expected temperature profile.

4. A method as set froth in claim 1, wherein the controlling step includes using control elements of separate cooling showers for adjusting the process parameters of the cooling line.

5. A method set froth in claim 4, wherein the controlling step includes controlling upper and lower control elements of separate cooling showers for independently controlling temperatures of strip upper and bottom surfaces.

6. A method as set forth in claim 4, wherein the controlling steps includes using the control elements for controlling at least one of a number of actuated cooling showers, amount of used cooling water, and velocity of the cooling water.

7. A method as set forth in claim 2, wherein the adapting step includes measuring the actual temperature shortly in front of a coiler.

8. A system for controlling a cooling line of a mill train for rolling strips and sheets and including a finishing train pyrometer provided between the last rolling stand of the finishing train and a beginning of the cooling line for measuring the temperature of a movable strip or sheet and a coiler pyrometer for measuring the strip or sheet temperature and provided between an end of the cooling line and the coiler, the system comprising:

means for calculating in advance a reference temperature profile between a site of finishing train pyrometer and a site of a coiler pyrometer based on a setup reference temperature;

means for calculating actual temperature profile of one of a sheet and a strip between the site of the finishing train pyrometer and the site of the coiler pyrometer based on actual adjusted process parameters of the cooling line and specific process conditions of the one of a sheet and a strip; and means for controlling individually the process parameters at particular locations of the cooling line by comparing the calculated actual temperature profile with the reference temperature profile at the particular locations.

9. A system as set forth in claim 8, further comprising means for measuring a temperature of the one of a strip and sheet, and means for adaptation of a model on which a calculation of actual temperature profile is based.

10. A system as set froth in claim 9, further comprising a process monitor-controller for compensating errors occurring despite an adaptation process.

* * * * *